US010900214B2

(12) United States Patent
Currivan

(10) Patent No.: US 10,900,214 B2
(45) **Date of Patent: *Jan. 26, 2021**

(54) CONCRETE GALLEY WATER DETENTION AND RELEASE SYSTEMS

(71) Applicant: Cur-Tech, LLC, Stamford, CT (US)

(72) Inventor: Frank J. Currivan, Riverside, CT (US)

(73) Assignee: Cur-Tech, LLC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/862,110

(22) Filed: Apr. 29, 2020

(65) Prior Publication Data

US 2020/0318336 A1 Oct. 8, 2020

Related U.S. Application Data

(63) Continuation-in-part of application No. 16/376,630, filed on Apr. 5, 2019, now Pat. No. 10,655,316.

(51) Int. Cl.
*E01F 5/00* (2006.01)
*E03F 1/00* (2006.01)

(52) U.S. Cl.
CPC ..... *E03F 1/002* (2013.01)

(58) Field of Classification Search
CPC ..... E03F 1/003; E02B 11/005
See application file for complete search history.

(56) References Cited

U.S. PATENT DOCUMENTS 3,416,321 A 12/1968 Saad
4,685,829 A 8/1987 Matiere
4,797,030 A 1/1989 Lockwood
5,449,020 A 9/1995 Matiere
5,803,662 A 9/1998 Gunter
5,890,838 A 4/1999 Moore, Jr. et al.
5,946,872 A 9/1999 Pardo
(Continued)

FOREIGN PATENT DOCUMENTS

CN 203904857 U 10/2014
EP 1749943 A2 2/2007
WO 2014158207 A1 10/2014

OTHER PUBLICATIONS

"CON/SPAN Concrete Detention and Infiltration", ConTech, https://www.conteches.com/stormwater-management/detention-and-infiltration/con-span-detention-system; downloaded from Internet on Dec. 20, 2018.

(Continued)

*Primary Examiner* — Benjamin F Fiorello
(74) *Attorney, Agent, or Firm* — St Onge Steward Johnston & Reens LLC

(57) ABSTRACT

An underground water detention and release chamber including two concrete galleys and a plastic or concrete cap. Each galley has a substantially horizontally disposed top deck and two substantially vertically disposed side walls. The top deck and side walls connecting at respective ends to form first and second side edges. The two galleys positioned parallel to and a distance apart each other such that adjacent side walls of the galleys define a longitudinal channel between the galleys. The cap spanning the longitudinal channel and includes an arch-shaped body having two side base portions. Each side base portion has a horizontal strut and a vertical strut extending away from the body such that each base conforms to a side edge of a respective galley to position the cap on the galleys. The cap has a plurality of reinforcing members.

23 Claims, 5 Drawing Sheets

(56) References Cited

U.S. PATENT DOCUMENTS

| | | | |
|---|---|---|---|
| 6,000,881 | A | 12/1999 | Becker et al. |
| 6,161,342 | A | 12/2000 | Barbier et al. |
| 6,474,907 | B2 | 11/2002 | Semotiuk et al. |
| 6,991,402 | B2 | 1/2006 | Burkhart |
| 7,305,798 | B1 | 12/2007 | Heierli |
| 7,530,764 | B1 | 5/2009 | Gallegos |
| 7,798,747 | B1 | 9/2010 | de Bruijn |
| 8,425,153 | B1 | 4/2013 | South |
| 8,491,224 | B2 | 7/2013 | Cobb et al. |
| 9,695,558 | B2 | 7/2017 | Aston et al. |
| 2002/0076280 | A1 | 6/2002 | Semotiuk et al. |
| 2004/0182017 | A1 | 9/2004 | Heierli |
| 2006/0233612 | A1 | 10/2006 | DiTullio |
| 2009/0279953 | A1 | 11/2009 | Allard et al. |
| 2010/0226721 | A1 | 9/2010 | May et al. |
| 2018/0112385 | A1 | 4/2018 | VanHoose et al. |

OTHER PUBLICATIONS

"Concrete vs Plastic for underground Detention / Retention Tanks", APD, (https://www.apd.co.nz/concrete-vs-plastic-for-underground-detentionretention-tanks/), May 27, 2015.

CONCRETE GALLEY WATER DETENTION AND RELEASE SYSTEMS

FIELD OF THE INVENTION

The present invention relates to water detention and release systems, and more particularly, to a concrete chamber and cap module for use in an underground system to receive and disperse stormwater runoff from paved and roofed areas and in septic applications.

BACKGROUND OF THE INVENTION

Traditionally, water detention and release systems for stormwater and/or septic purposes were constructed by burying concrete pipes, chambers or galleys in infiltration trenches backfilled with large gravel or crushed stone. Underground pipes supplied the system with water, which would be detained in the system until it naturally released into the ground underlying the concrete chambers. Concrete chambers or galleys are sturdy and are usually available at commercially acceptable prices from concrete precast companies. However, they are heavy and require heavy duty excavation equipment to move and install them. Also, they have definite sizes and shapes and are not conveniently modified or resized if an installation requires less than a complete chamber or galley or if during installation excavations it is discovered that there is buried rock or rock ledge that impinges on the planned position of the chamber or galley.

Water detention and release systems have also been constructed from plastic piping and molded plastic chambers. These systems are buried in trenches backfilled with crushed stone. Often such systems require large volumes of crushed stone to backfill the trenches. Plastic water detention and release systems are convenient to transport, install, and modify as needed during installation. However, the requirement for crushed stone beds to contain such plastic structures may cause challenges to the installer if there is limited clean crushed stone available in the area of the construction site at a commercially acceptable price.

What is needed, therefore, is an underground water detention and release system that forms a chamber that can retain large volumes of water. The desired system would be both stronger and more cost efficient than existing design approaches.

SUMMARY OF THE INVENTION

Accordingly, embodiments of the present invention include systems and methods for detaining and releasing stormwater.

In one embodiment of the present invention, an underground water detention and release system has a first galley, a second galley, and one or more caps. The first galley includes a first top deck, a first side wall, and a second side wall. The first top deck has a first side edge and a second side edge opposite the first side edge. The first side wall extends from the first side edge substantially perpendicular to the first top deck, and the second side wall extends from the second side edge substantially perpendicular to the first top deck. The second galley includes a second top deck, a third side wall, and a fourth side wall. The second top deck has a third side edge and a fourth side edge opposite the third side edge. The third side wall extends from the third side edge substantially perpendicular to the second top deck, and the fourth side wall extends from the fourth side edge substantially perpendicular to the second top deck. The first and second galleys are positioned substantially parallel to each other such that the second and third side walls define a longitudinal channel between the first and second galleys. The first and second galleys provide underground water detention volume within the space defined by their walls. The one or more caps span the longitudinal channel and enclose the space of the longitudinal channel to provide additional underground water detention volume. The cap has an arch-shaped top portion and two side base portions for positioning the cap on the first and second galleys.

In some embodiments, each side base portion of the cap includes a horizontal strut and a vertical strut extending away from the top portion such that a first side base portion conforms to the second side edge of the first galley and a second side base portion conforms to the third side edge of the second galley to position the cap on the first and second galleys.

In some embodiments, the cap further includes a plurality of perforations distributed across the top portion.

In some embodiments, the cap further includes a plurality of reinforcing members extending transversely to a longitudinal axis of the cap.

In some embodiments, the cap further includes a slot provided on an upper surface of a first end of the cap, and a corresponding lip on a lower surface of a second end of the cap such that the slot of a first cap can interlock with the lip of a second matching cap to secure the first end of the first cap to the second end of the second matching cap.

In some embodiments, each of the side walls of the first and second galleys has at least one opening defining at least one lateral channel in the module.

The first and second galleys are formed of concrete, and the cap is formed of concrete, plastic or another appropriate material.

The system may include one or more system units as described above positioned in series or in parallel. An in series system may include two or more first galleys and two or more second galleys with a plurality of caps positioned over the longitudinal channel formed therebetween. An in-parallel system may include one or more first galleys, one or more second galleys, and additionally one or more third galleys positioned substantially parallel to the one or more second galleys to define a second longitudinal channel between the second and third galleys. The second longitudinal channel is covered by one or more caps that span the second longitudinal channel to provide additional underground water detention volume.

DETAILED DESCRIPTION OF THE INVENTION

Figure 1:
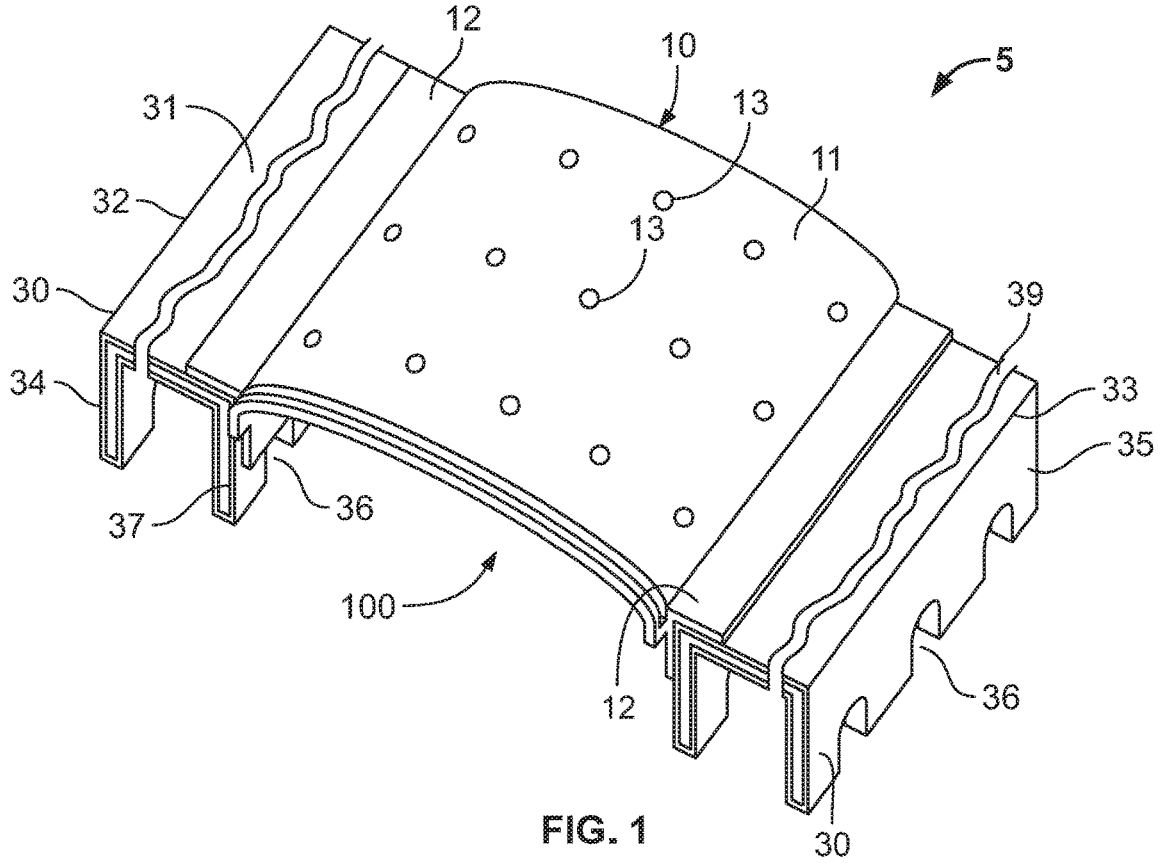
FIG. 1 is a perspective view of an underground water detention and release chamber module according to a first embodiment of the present invention.
Figure 2:
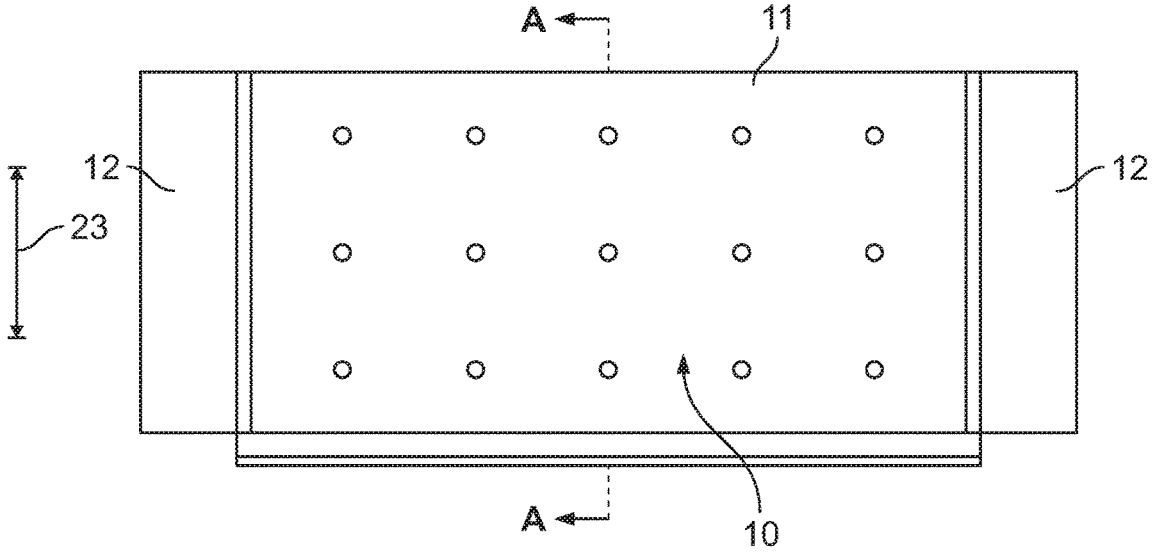
FIG. 2 is a top plan view of the cap of FIG. 1.

Referring now to the drawings, wherein like reference numerals designate corresponding structure throughout the views. The following examples are presented to further illustrate and explain the present invention and should not be taken as limiting in any regard.

FIG. 1 shows an underground water detention and release system 5 defining a chamber 100 according to an embodiment of the present invention. Chamber 100 has two galleys 30. Preferably, galleys 30 are formed of concrete, and in some embodiments, galleys 30 are of matching shape and design. Galley 30 has a top deck 31, and two side walls 34/35 that connect to top deck 31 to create two side edges 32/33. Top deck 31 is substantially horizontally disposed across the length and width of galley 30. Side walls 34/35 are substantially perpendicular to top deck 31 such that side walls 34/35 are substantially vertically disposed across the height of galley 30. As used herein referring to angular orientation, the term "substantially" encompasses both the named angle (i.e. perpendicular, horizontal, vertical, etc.) and a range of unnamed angles that reasonably accounts for errors inherent in the manufacturing processes. For example, side wall 34 may be substantially perpendicular to top deck 31 if side wall 34 is angled 85°-95° from top deck 31.

In preferred embodiments, galleys 30 are 4 feet wide by 8 feet long, or 4 feet wide by 4 feet long. However, other proportions may be adopted based on considerations of manufacturing, storage, transporting, palleting, metric vs. SAE standards, etc. For example, galleys 30 may be 2 feet wide by 8 feet long, or 2 feet wide by 4 feet, or 1 foot wide by 4 feet long, etc. Thus, the galleys 30 in FIG. 1 contain break lines 39 to indicate that the width of the galleys 30 can be greater than shown in the drawing. The height of galleys 30 may similarly be determined according to the requirements for storage capacity and commercial considerations. Exemplary heights of galleys 30 are 1 foot, 2 feet, 3 feet or 4 feet. In some applications, galleys 30 may be designed, sized, and manufactured to meet the size requirements of a specific job site.

Preferably, the galleys 30 are positioned adjacent each other a distance apart and are aligned substantially parallel with each other. Side wall 35 of one galley 30 faces side wall 34 of another galley 30 to define a longitudinal channel of the chamber 100. Preferably, the longitudinal channel is centrally located in the chamber 100. In some embodiments, the width of the longitudinal channel is in the range of about 25% to about 200% of the width of the galley 30. In preferred embodiments, the width of the longitudinal channel is in the range of about equal to the width of the galley 30. As used herein referring to percentage ranges, the term "about" encompasses both the named percentages and a range of unnamed percentages that reasonable account for errors inherent in the manufacturing processes. In preferred embodiments, the width of the longitudinal channel is about 3 feet. Thus for example, if galley 30 is 4 feet wide by 8 feet long, the width of the longitudinal channel may be 3 feet wide, which is about 75% of the width of the galley 30. In another example, if galley 30 is 2 feet wide by 4 feet long, the width of the longitudinal channel might be 2 feet wide, which is about 100% of the width of the galley 30; or alternatively, the width of the longitudinal channel might be 4 feet wide, which is about 200% of the width of the galley 30.

In preferred embodiments, the galleys 30 each have at least one opening 36 in each side wall 34 and 35 defining at least one lateral channel of the chamber 100. In some embodiments, the galleys 30 each have at least one opening 36 in only the side wall 34/35 that defines the longitudinal channel to define at least one lateral channel that does not pass all the way through the chamber 100, as shown in FIGS. 6-7.

Figure 6:
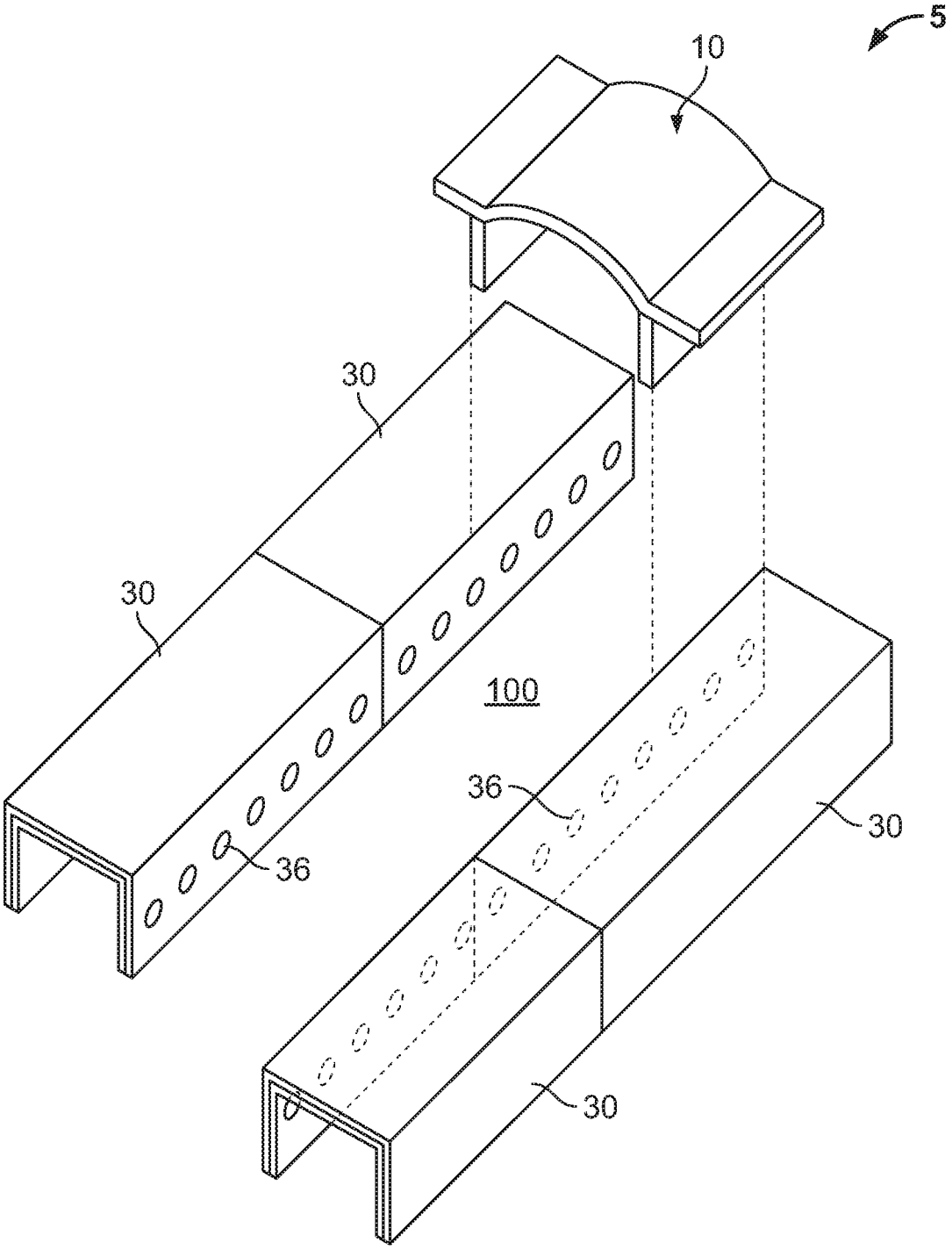
FIG. 6 is a partially exploded perspective view of an underground water detention and release system according to a second embodiment of the present invention.
Figure 7:
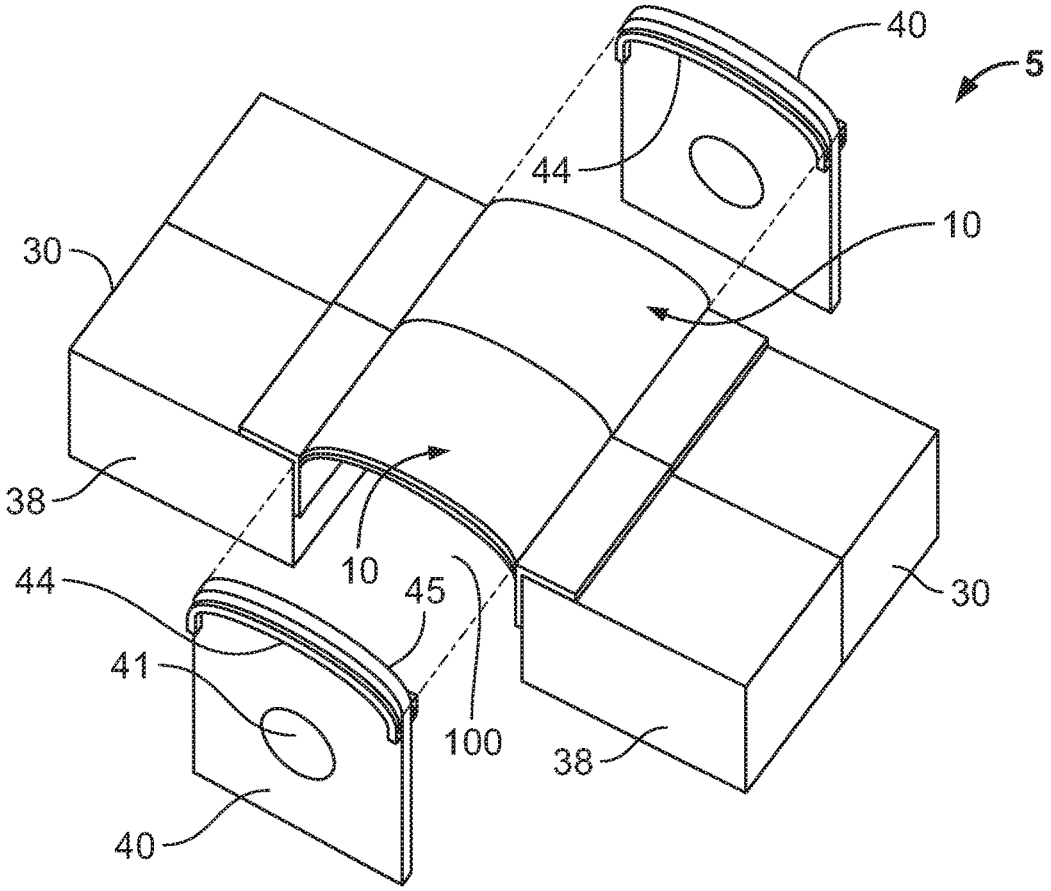
FIG. 7 is a partially exploded perspective view of an underground water detention and release system according to a third embodiment of the present invention.
Figure 8:
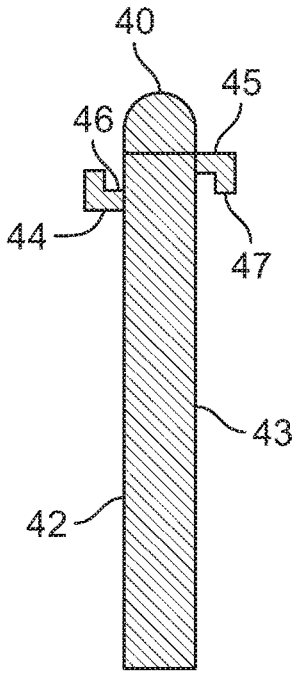
FIG. 8 is a side cross-sectional view of the end plate of FIG. 7.

Preferably, the galley 30 is configured to connect in line to matching galleys 30 such that multiple chambers 100 can be joined end-to-end to form a continuous chamber 100 with a longitudinal channel, as shown in FIGS. 6-7. In some embodiments, galley 30 has a recess 37 on one end and a corresponding protrusion on an opposite end such that galleys can link together by inserting the protrusion of one galley into the recess of another galley. In other embodiments, galley 30 has at least one end wall 38, as shown in FIG. 7. In yet other embodiments, galley 30 is sealed with a separate end plate.

Chamber 100 also includes a cap 10. In one embodiment, cap 10 is formed of precast concrete. In another embodiment, cap 10 is formed of a plastic material, preferably acrylonitrile butadiene styrene (ABS), but other plastics may be used, including such as polyethylene, and polypropylene. In other embodiments other materials of an appropriate strength and weight may be used. For example, in some embodiments, cap 10 may be formed of non-ferrous metals, alloys of ferrous metals, and appropriately treated ferrous materials such as galvanized steel. Cap 10 has a top portion or body 11 that is preferably arch-shaped. Body 11 is preferably approximately as wide as the longitudinal channel such that the cap 10 spans the longitudinal channel when secured to the galleys 30. In preferred embodiments, the body 11 has a plurality of perforations 13 distributed across the body 11. Perforations 13 are through-holes to permit water to percolate through the cap 10 to be received from or released to the surrounding stone/soil. In some embodiments, the body 11 does not contain perforations 13, as shown in FIGS. 6-7. By spanning the longitudinal channel with the arch-shaped cap 10, the chamber 100 retains significantly greater volumes of water than the galley components alone. Also, the arch-shaped cross-section of cap 10 significantly reduces the volume of crushed stone required to backfill chamber 100 because the spaces between the galleys 30 (i.e. the longitudinal channels) are used to retain water, and the height of the arch-shaped body 11 maximizes the volume of the longitudinal channel. In preferred embodiments, the body 11 has a maximum height that is about three inches above the top deck 31 of galley 30. In some embodiments, the body 11 has a maximum height that is in the range of about one inch to about eleven inches above the top deck 31 of galley 30. In other embodiments, the body 11 has a maximum height that is in the range of about two inches to about six inches above the top deck 31 of galley 30.

Cap 10 has two side base portions 12 configured to position the cap 10 on the galleys 30. In preferred embodiments, each side base portion 12 has a horizontal strut 21 and a vertical strut 22. Struts 21/22 are configured to generally conform to the side edges 32/33 of galley 30 such that horizontal strut 21 rests on top deck 31 of galley 30 and vertical strut 22 rests against side wall 34/35 of galley 30. After installation of the water detention and release system 5 and when the cap 10 is covered with stone and soil, the weight on the cap 10 applies load to the body 11 of the cap 10 causing the vertical struts 22 to press against the side walls 34/35 of galleys 30, retaining the cap 10 to the galleys 30.

Figure 3:
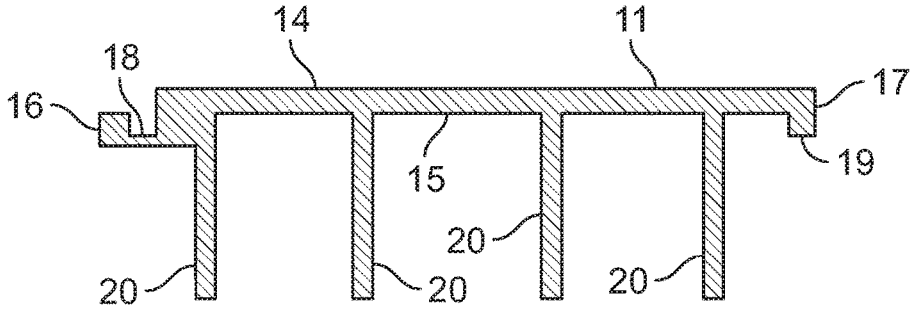
FIG. 3 is a section view of the cap along the line A-A of FIG. 2.
Figure 4:
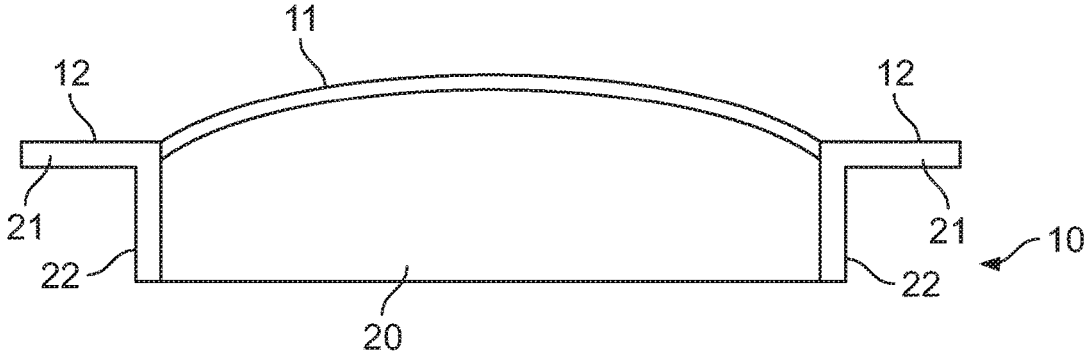
FIG. 4 is a front elevational view of the cap of FIG. 1.
Figure 5:
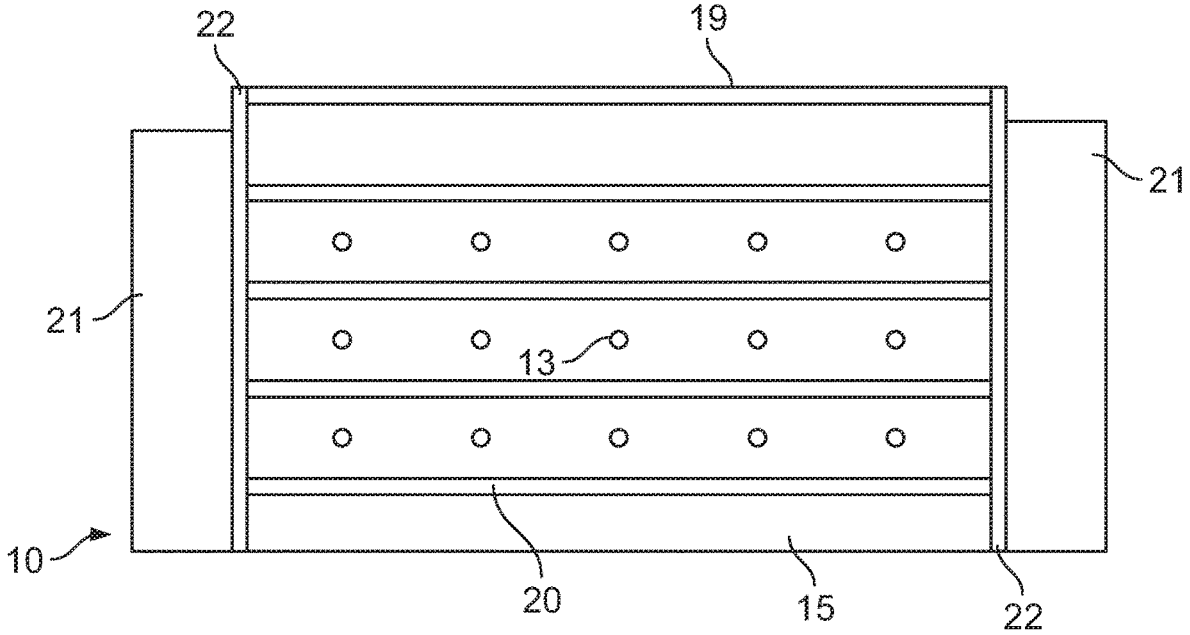
FIG. 5 is a bottom plan view of the cap of FIG. 1.

Preferably, the cap 10 has a plurality of reinforcing members 20 distributed across the length of the body 11. Each reinforcing member 20 is disposed transverse to the longitudinal axis 23 of the cap 10. Reinforcing members 20 serve to strengthen the structural integrity of the cap 10 by increasing the amount of stress forces that body 11 can sustain before collapsing. In preferred embodiments, reinforcing members 20 are ribs located on the bottom surface 15 of body 11, as shown in FIGS. 3-5. In some embodiments, the ribs 20 abut the vertical struts 22 to further ensure that the vertical struts 22 are secured against the side walls 34/35 of the galleys 30. In other embodiments, the lower end of ribs 20 are contoured to have an arch-shape that corresponds to body 11 such that multiple caps 10 can be stacked and efficiently shipped in large quantities. In some embodiments, reinforcing members 20 are corrugations, sub-corrugations, a combination thereof, a combination of corrugations and ribs, etc.

In preferred embodiments, the cap 10 has a lip 19 located on the bottom surface 15 at one end 17, and a corresponding slot 18 located on the top surface 14 at another end 16, as depicted in FIG. 3. Thus, multiple chambers 100 can interlock end-to-end by inserting the lip 19 of one cap 10 into the slot 18 of another cap 10, as shown in FIG. 7. In some embodiments, as shown in FIG. 6, cap 10 has flat ends that merely abut the corresponding end of an adjacent cap 10 when arranged end-to-end.

Figure 9:
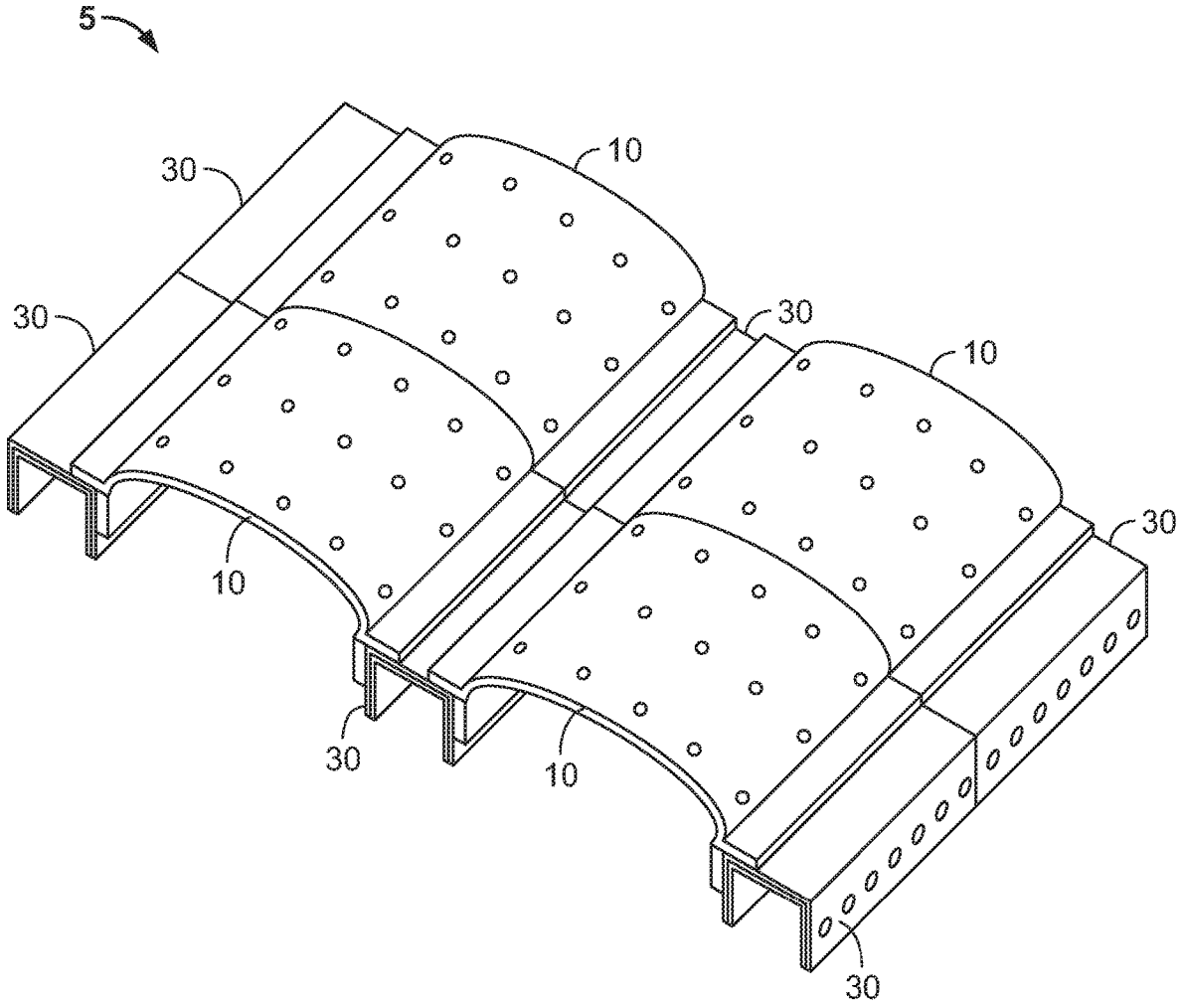
FIG. 9 is a perspective view of an underground water detention and release system according to a fourth embodiment of the present invention.

The system 5 contemplates use of any number of chambers connected end-to-end to form a row of chambers. In some embodiments, the underground water detention and release system has a grid layout having multiple rows of galleys 30 adjacent each other forming multiple continuous longitudinal channels, with a row of caps 10 spanning each longitudinal channel, as shown in FIG. 9.

In preferred embodiments, the ends of the longitudinal channel are sealed with end plates 40, as shown in FIG. 7. End plates 40 are preferably made of a plastic material, and have an arch-shaped top portion that conforms to the arch of body 11 of cap 10. In some embodiments, end plate 40 has a protrusion 45 on one end surface 43 and a protrusion 44 on the opposite end surface 42. Preferably, protrusion 45 has a lip 47 that corresponds to slot 18 of cap 10, and protrusion 44 has a slot 46 that corresponds to lip 19 of cap 10 such that end plate 40 can be securely fitted to either end 16/17 of cap 10. Lip 47 also corresponds to slot 46 to enable efficient stacking, storing, and shipping of end plates 40. In preferred embodiments, end plate 40 has an opening 41 extending therethrough for receiving a feed pipe, which supplies water to the system. In some embodiments, opening 41 is not precut but is merely delineated on end surfaces 42/43 such that opening 41 can be cut on-site as necessary.

Installation of system 5 will involve excavation of a worksite, leveling the excavation worksite with suitable bed material such as crushed stone or sand. A first concrete galley 30 having a first top deck 31 and first and second downwardly-extending side walls 34/35 is placed in the excavated worksite, and a second concrete galley 30 having a second top deck 31 and third and fourth downwardly-extending side walls 34/35 is placed in the excavated worksite substantially parallel to and a distance apart from the first galley 30. The positioning of the two galleys provides a longitudinal channel between the first and second galleys. Then a cap 10 having an arch-shaped top portion 11 and two side base portions 12, each side base portion having a horizontal strut 21 extending laterally away from the top portion and a vertical strut 22 extending downwardly from the top portion, is placed over the longitudinal channel by positioning the horizontal struts of the side base portions on the first and second galleys, thereby forming a chamber 100. A second cap 10 can be placed adjacent the first cap 10 and desirably, the first cap and second cap have a slot 18 on one surface of a first end of each cap, and a corresponding lip 19 on a lower surface of a second end of each cap such that the slot 18 of a first cap can interlock with the lip 19 of a second matching cap to retain the first end of the first cap to the second end of the second cap. In a preferred embodiment, the slot 18 is open to and provided on an upper surface 14 of the top portion 11 at the first end 16 of the cap 10, and the lip 19 is provided on and extends downwardly from a lower surface 15 of the top portion 11 at the second end 17 of the cap 10. End plates 40 may be placed at one end or at two ends of the chamber.

In some cases, a third concrete galley 30 can be placed in the excavated worksite substantially parallel to and a distance apart from the second galley to provide a longitudinal channel between the second and third galleys and another cap 10 having an arch-shaped top portion and two side base portions seated over the longitudinal channel, thereby forming a second chamber.

Although the invention has been described with reference to a particular arrangement of parts, features, and the like, and a particular method of assembling these arrangements and features, these are not intended to exhaust all possible arrangements, features, or methods of assembly. Indeed, many other modifications and variations will be ascertainable to those of skill in the art.

What is claimed is:

1. A water detention and release system comprising:
- a first concrete galley having:
  - a first top deck having a first side edge and a second side edge opposite the first side edge;
  - a first side wall extending from the first side edge substantially perpendicular to the first top deck; and
  - a second side wall extending from the second side edge substantially perpendicular to the first top deck;
- a second concrete galley having:
  - a second top deck having a third side edge and a fourth side edge opposite the third side edge;
  - a third side wall extending from the third side edge substantially perpendicular to the second top deck; and
  - a fourth side wall extending from the fourth side edge substantially perpendicular to the second top deck;
- the second galley being positioned substantially parallel to and a distance apart from the first galley such that the second and third side walls define a longitudinal channel between the first and second galleys; and
- a concrete cap spanning the longitudinal channel to form a chamber, the concrete cap having an arch-shaped top portion and two side base portions for positioning the concrete cap on the first and second galleys, each side base portion comprising a horizontal strut extending laterally away from the top portion and a vertical strut extending downwardly away from the top portion.

2. The water detention and release system of claim 1, wherein a first side base portion conforms to the second side edge of the first galley and a second side base portion conforms to the third side edge of the second galley to position the cap on the first and second galleys.

3. The water detention and release system of claim 1, wherein the concrete cap further comprises a plurality of perforations distributed across the top portion.

4. The water detention and release system of claim 1, wherein the concrete cap further comprises a plurality of reinforcing members extending transverse to a longitudinal axis of the cap.

5. The water detention and release system of claim 1, wherein the concrete cap further comprises a slot on an upper surface of a first end of the cap, and a corresponding lip on a lower surface of a second end of the concrete cap such that the slot of a first concrete cap can interlock with the lip of a second matching concrete cap to retain the first end of the first concrete cap to the second end of the second matching concrete cap.

6. The water detention and release system of claim 1, wherein each of the side walls of the first and second galleys has at least one opening defining at least one lateral channel in the module.

7. The water detention and release system of claim 1, further comprising:

a third concrete galley having a third top deck having a fifth side edge and a sixth side edge; a fifth side wall extending from the fifth side edge substantially perpendicular to the third top deck; a sixth side wall extending from the sixth side edge substantially perpendicular to the third top deck;

the third galley being positioned substantially parallel to and a distance apart from the second galley such that the fourth and fifth side walls define a second longitudinal channel between the second and third galleys; and a second concrete cap spanning the second longitudinal channel to form a second chamber, the second concrete cap having an arch-shaped top portion and two side base portions for positioning the second concrete cap on the second and third galleys.

8. The water detention and release system of claim 7, wherein each side base portion of the second concrete cap comprises a horizontal strut and a vertical strut extending away from the top portion such that a third side base portion conforms to the fourth side edge of the second galley and a fourth side base portion conforms to the fifth side edge of the third galley to position the second concrete cap on the second and third galleys.

9. The water detention and release system of claim 8, wherein the second concrete cap further comprises a plurality of perforations distributed across the top portion.

10. The water detention and release system of claim 8, wherein the second concrete cap further comprises a plurality of reinforcing members extending transverse to a longitudinal axis of the cap.

11. The water detention and release system of claim 8, wherein the second concrete cap further comprises a slot on an upper surface of a first end of the second concrete cap, and a corresponding lip on a lower surface of a second end of the second concrete cap.

12. A cap for a water detention and release system comprising:

a top portion having two sides and an upwardly extending arch shape between the two sides;

a base portion located at each of the two sides of the top portion, each base portion having a horizontal strut extending laterally away from the top portion and a vertical strut extending downwardly from the top portion; a plurality of reinforcing members extending downwardly from the arch shaped top portion and transversely to a longitudinal axis of the cap.

13. The cap of claim 12, wherein the cap further comprises a slot on one surface of the top portion at a first end of the cap, and a lip on an opposite surface of the top portion of a second end of the cap, said lip being adapted to fit into the slot.

14. The cap of claim 13, wherein the slot is open to and provided on an upper surface of the top portion at the first end of the cap, and the lip is provided on and extends downwardly from a lower surface of the top portion at the second end of the cap, said lip being adapted to fit into the slot.

15. The cap of claim 12, further comprising a plurality of perforations distributed across the arch-shaped top portion.

16. The cap of claim 12, wherein the cap is a concrete cap.

17. A method of providing a water detention and release system comprising:

placing a first concrete galley having a first top deck and first and second downwardly-extending side walls in a excavated worksite; placing a second concrete galley having a second top deck and third and fourth downwardly-extending side walls in the excavated worksite substantially parallel to and a distance apart from the first galley to provide a longitudinal channel between the first and second galleys; and placing a cap having an arch-shaped top portion and two side base portions, each side base portion having a horizontal strut extending laterally away from the top portion and a vertical strut extending downwardly from the top portion, over the longitudinal channel by positioning the horizontal struts of the side base portions on the first and second galleys, thereby forming a chamber.

18. The method of claim 17, further comprising placing a second cap having an arch-shaped top portion and two side base portions, each side base portion having a horizontal strut extending laterally away from the top portion and a vertical strut extending downwardly from the top portion, over the longitudinal channel by positioning the horizontal struts of the side base portions on the first and second galleys.

19. The method of claim 17, wherein the cap is a concrete cap.

20. The method of claim 18, wherein the cap is a concrete cap and the second cap is also a concrete cap.

21. The method of claim 18, further comprising:

placing a third concrete galley having a third top deck and fifth and sixth downwardly-extending side walls in the excavated worksite substantially parallel to and a distance apart from the second galley to provide a longitudinal channel between the second and third galleys; and placing a third cap having an arch-shaped top portion and two side base portions, each side base portion having a horizontal strut extending laterally away from the top portion and a vertical strut extending downwardly from the top portion, over the longitudinal channel by positioning the horizontal struts of the side base portions on the second and third galleys, thereby forming a second chamber.

22. The method of claim 21, wherein the third cap is a concrete cap.

23. The method of claim 18, wherein the cap and second cap each have a slot on one surface of a first end of each cap, and a corresponding lip on a lower surface of a second end of each cap such that the slot of a first cap can interlock with the lip of a second cap to retain the first end of the first cap to the second end of the second cap.

* * * * *